United States Patent [19]

Swartz et al.

[11] 4,178,646

[45] Dec. 18, 1979

[54] VIAL CAP OPENER DEVICE

[76] Inventors: Peter J. Swartz, 33 Pine Ave., Randolph, Mass. 02368; Ronald J. Sostek, 51 Ansie Rd., Chelmsford, Mass. 01824

[21] Appl. No.: 903,880

[22] Filed: May 26, 1978

Related U.S. Application Data

[63] Continuation-in-part of Ser. No. 780,285, Mar. 23, 1977, abandoned.

[51] Int. Cl.[2] ..... B67B 7/36

[52] U.S. Cl. ..... 7/156; 81/3.1 R; 81/3.48

[58] Field of Search ..... 7/151, 156; 81/3.1 R, 81/3.48, 3.49; 30/1.5

[56] References Cited

U.S. PATENT DOCUMENTS 2,261,729 11/1941 Miller ..... 81/3.1 R X

*Primary Examiner*—James G. Smith

*Attorney, Agent, or Firm*—William Nitkin

[57] ABSTRACT

A vial sealing cap opening device comprised of a body member having a channel defined therein, the sides of the channel being spaced apart a distance slightly greater than the diameter of the vial sealing caps to be opened and a blade member disposed within the channel and elevated above the back wall of the channel a distance sufficient so that the blade's tip will enter a perforation in the vial sealing cap when the vial is inserted in the channel perpendicularly to the body member and manually moved against the blade. The device further includes a vial sealing cap lift tab deformer and sealing cap ring remover.

7 Claims, 9 Drawing Figures

VIAL CAP OPENER DEVICE

This application is a continuation in part of our prior application for a Vial Cap Opener filed Mar. 23, 1977, Ser. No. 780,285, now abandoned.

BACKGROUND OF THE INVENTION

This invention relates to devices for the opening of containers and more particularly relates to a vial sealing cap remover.

Many vials are manufactured having a seal created by a rubber-like plug inserted into the opening of the vial held securely in place by a metallic sealing cap. Such vials are common in medical applications. Usually their sealing caps can be manually removed by first inserting one's fingernail under the sealing cap's central lift tab, prying it upwards, and then grasping the lift tab and tearing it away from the vial thereby breaking one or more partially scored areas in the cap's ring section which is sealed around the plug and lip of the vial. In one type of vial one can then remove the remainder of the sealing cap's ring section and lift the plug out of the mouth of the vial thereby gaining access to the contents of the vial. In vials containing injectable fluids the plug and ring section are left in place and one inserts a syringe needle through the plug to extract the vial's contents.

Some individuals lack the manual dexterity required or proper fingernail length and such individuals may encounter great difficulty in opening such sealing caps. Further the metallic sealing cap often twists in a ragged fashion exposing sharp thin edges which can cut both the individual attempting to remove the sealing cap and others who may come in contact with carelessly discarded caps.

There is currently a plier-like device made for the specific purpose of cutting the metallic sealing caps of such vials, but such device has the twofold disadvantage in that it may be moved from place to place and may not always be readily available when one wishes to open a vial, and the device requires manual dexterity to insert it under the metallic sealing cap's lift tab.

SUMMARY

It is an object of the present invention to provide an economical device which can be wall-mounted if desired with which individuals can easily and safely remove the metallic sealing caps from vials to gain access to their contents.

The device of this invention has a further object in encouraging the centralized collection of waste sealing caps which, as mentioned above, can cause cuts if carelessly handled. A waste container may be positioned below the device of this invention for the metallic sealing caps to fall into.

The device of this invention is comprised of a body member which can be handheld or adapted to be mounted on an upright surface at locations where such vials are usually opened. Defined within the device is a channel with sides spaced apart a distance approximating the diameter of the vial sealing cap to be removed. within this channel is disposed a blade member adapted to slide under the sealing cap's lift tab when the vial is inserted perpendicularly to the body member, sealing cap first, into the channel and manually slid downward.

In practice one first can deform the sealing cap's lift tab on a lift tab deformer positioned at the top of the channel and by rotating the vial upwards, one can enlarge the sealing cap's lift tab perforation. Then one moves the vial in the channel holding it perpendicularly to the body member so that its sealing cap makes contact with the blade member, causing the blade member to enter through the sealing cap's lift tab perforation and engage the sealing cap's lift tab member. With a slight outward movement of the vial along the contoured portion of the body member below the blade member, the sealing cap's lift tab is released and may fall into a waiting container or may adhere to the blade member to be manually lifted off and deposited into a waste container. The remaining sealing cap ring member can be removed by rotating the vial in the sealing cap ring removal aperture defined in each side of the body member which movement causes the displacement of the sealing cap ring off the vial.

In further detail the device comprises a body member having a channel defined therein, said channel having a back wall, a top, an open front, a bottom, and sides which are spaced apart a distance at least slightly greater than the maximum width of the lift tab; and a blade bridging a portion of the front of the channel and mounted on the body member so as to be approximately parallel to the back wall and spaced forward from it so that when the vial is held perpendicular to the blade adjacent to the back wall and moved so as to bring the vial cap into proximity with the blade, further motion of the vial causes the blade to enter into the space inside the vial cap immediately beneath a portion of the lift tab whereby the lift tab can be more readily separated from the surface of the vial cap. In a preferred embodiment the blade can be disposed near the bottom of the channel and the channel can be of sufficient length so that the vial cap can enter into the channel from a position above the blade and the device can further include a stop element affixed to the body member, located in front of the blade, and having a contact edge located below the blade, so that the stop element's contact edge first comes in contact with the vial and prevents further direct downward movement of the vial cap after the blade has entered the space beneath the previously bent away portion of the vial cap; and a lift slope affixed to the stop element, and mounted on the body member immediately below the contact edge of the stop element to assist in guiding the vial cap in a direction forward from the blade as the vial cap is simultaneously moved in a generally downward direction after it has contacted the stop element, thereby further assisting in removing the lift tab.

In addition the device can include means for deforming the vial cap in such a way that a portion of the lift tab is caused to be partially bent away from and out of the outside surface of the vial cap, whereby the balance of the lift tab can thereafter be more readily removed through proper manipulation of the vial cap in relation to the blade. Such means can comprise a short projection from the body member that has an area relatively small in relation to the vial cap and which can be located in a recess within the back wall of the channel.

The device can further include means incorporated into said body member for assisting in removing from the vial the ring member portion of the vial cap remaining after the lift tab has been substantially removed. Such means can comprise a portion of the body member having an aperture defined therein of size sufficient to receive an edge of the vial sealing cap with at least one edge of such aperture adapted to catch against the ring member fragment remaining after substantial removal of the lift tab.

The device can be mounted on a surface to facilitate manipulation of the vial and vial cap with respect to the device, such mounting being accomplished in one embodiment by means of an adhesive surface affixed to a portion of the body member.

Further details of the device and its operation will become clearer when reference is made to the following attached drawings and descriptions thereof.

DESCRIPTION OF THE PREFERRED EMBODIMENT

Figure 1:
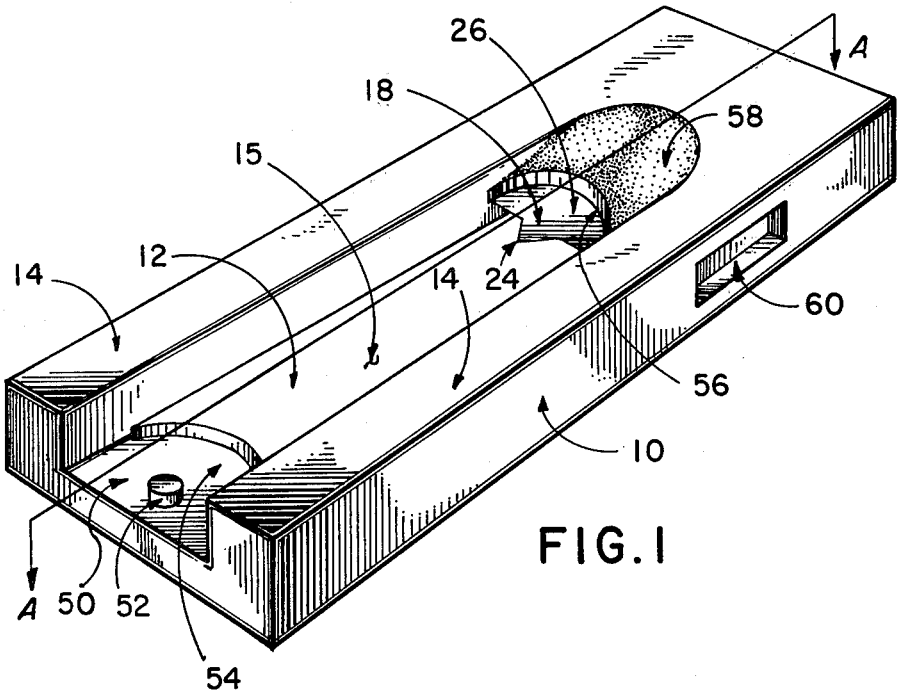
FIG. 1 illustrates a perspective view of the device of this invention.
Figure 8:
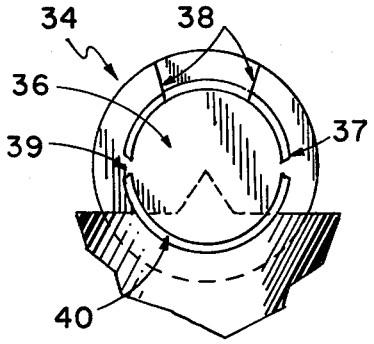
FIG. 8 illustrates a blade member engaged under a sealing cap lift tab.
Figure 9:
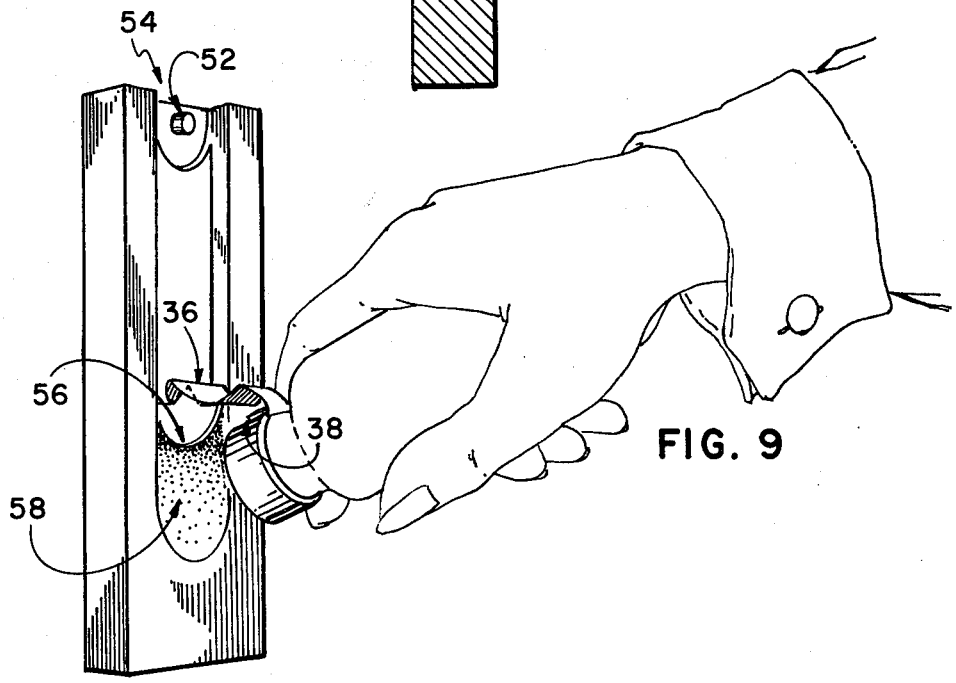
FIG. 9 illustrates a sealing cap lift tab caught on a blade member.

FIG. 1 illustrates a perspective view of the device of this invention showing body member 10 having channel 12 defined therein, the sides of which are formed by channel side members 14. Within channel 12 is seen blade member 18. Blade member 18 is comprised of blade tip 24 and blade base element 26. Blade member 18 is positioned above back wall 15 of channel 12 a distance designed so that when a vial is inserted perpendicularly to body member 10 into the channel, sealing cap first, and moved against blade member 18 so that its sealing cap lift tab perforation 40, as seen in FIG. 8, is facing the blade tip, blade tip 24 will enter into perforation 40 and will separate sealing cap lift tab 36 from the remainder of sealing cap 34, as illustrated in FIG. 9.

Figure 7:
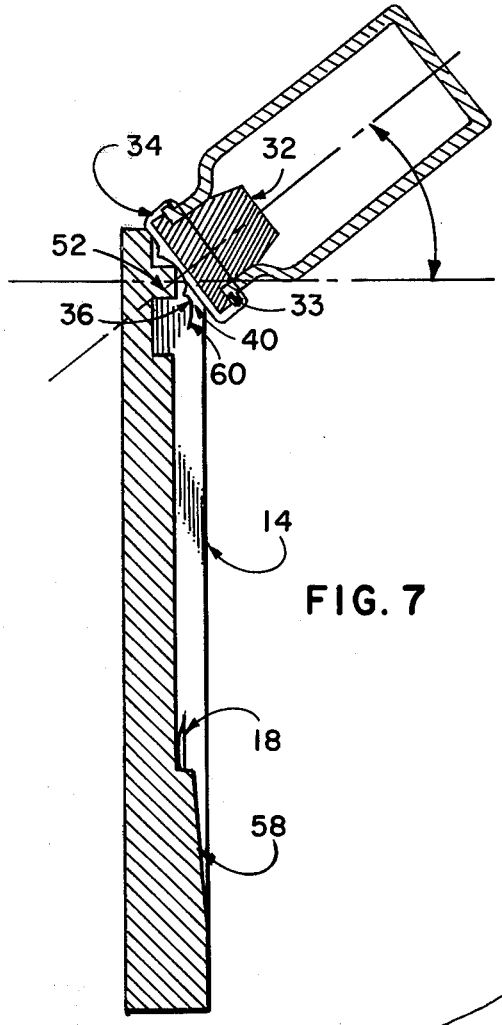
FIG. 7 illustrates a cross-section through A—A of FIG. 1 showing a vial being rotated on the lift tab deformer.

At the top of the device is lift tab deformer 50 comprised of deformer projection 52 and deformer recess 54 in back wall 15 of channel 12. In practice one places the vial sealing cap against deformer projection 52 and rotates the vial upwards as seen in FIG. 7, which movement deforms the vial sealing cap lift tab 36 so that blade tip 24 can easily enter sealing cap lift tab perforation 40.

It should be noted that blade tip 24 should advance only to the midsection of lift tab 36, and stop element 56, a semicircular rise at the base of blade member 18 is provided in body member 10. In a smooth continuous outward movement one then slides the vial slightly outwards over stop element 56 and along contoured lift slope 58. As the vial moves downwards and outward, the sealing cap lift tab 36 is broken away from ring member 37 along scores 38.

If the vial is of the type having a plug which must be removed to gain access to its contents, the remaining sealing cap ring member can be removed by inserting the top of the vial into ring cap remover 60, a rectangular aperture defined in the side of body member 10 being of a size sufficient to receive an edge of the vial sealing cap and having at least one edge adapted to catch against the sealing cap ring member. Rotation of the vial within ring cap remover 60 causes one of the open sides of the sealing cap ring member to catch against body member 10 and be displaced from the vial. Ring cap remover 60 can be located on either side of the device or located on both sides for ease of use by both right-handed and left-handed individuals.

Figure 2:
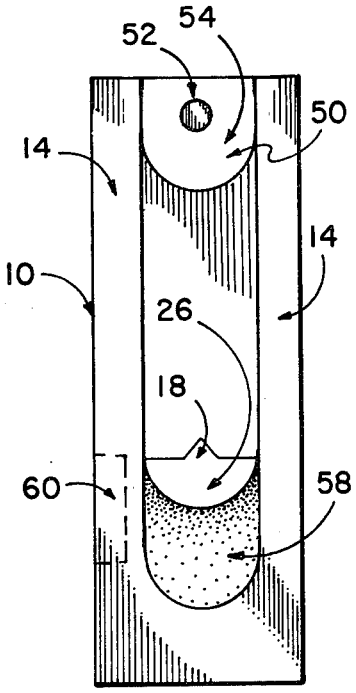
FIG. 2 illustrates a front view of the device of this invention.

FIG. 2 illustrates a front view of the device of this invention showing some of the same elements shown in FIG. 1.

Figure 3:
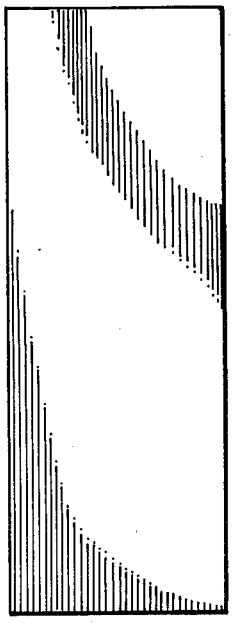
FIG. 3 illustrates a rear view of the device of this invention.

FIG. 3 illustrates a rear view of the device of this invention.

Figure 4:
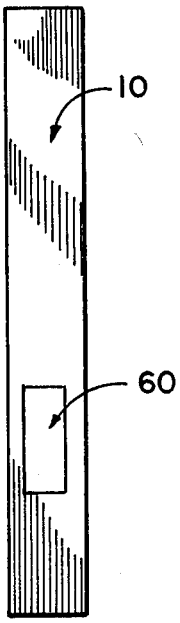
FIG. 4 illustrates a side view of the device of this invention.

FIG. 4 illustrates a side view of the device of this invention showing ring cap remover 60.

Figure 5:
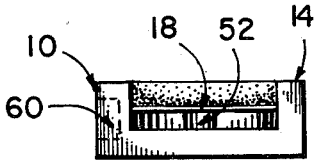
FIG. 5 illustrates an end top view of the device of this invention.

FIG. 5 illustrates an end top view of the device of this invention.

Figure 6:
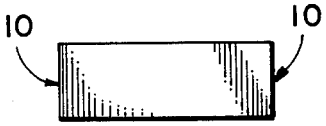
FIG. 6 illustrates an end bottom view of the device of this invention.

FIG. 6 illustrates an end bottom view of the device of this invention.

FIG. 7 illustrates a cross-sectional view through A—A of FIG. 1 showing lift tab deformer 50. Also seen in this view are sealing cap 34 and vial plug 32 within the mouth of the vial. The metallic sealing cap is shown crimped around the base of vial lip 33. By rolling the vial upwards as indicated by the arrows, one causes deformer projection 52 to make a depression slightly above the lift tab's center thereby causing front lip 60 of the lift tab to move away from the rest of the sealing cap.

FIG. 8 illustrates a cut-away sectional view of blade tip 24 engaged under sealing cap lift tab 36. As seen in this view, blade tip 24 has entered one of the sealing cap lift tab perforations 40 and sealing cap lift tab attachment member 39 is making contact with blade ring catch element 26. It should be noted that some vials do not have sealing cap lift tab attachments. In practice one then continues to lower the vial causing the illustrated sealing cap lift tab attachment member 39 to break and further causing blade member 18 to catch sealing cap lift tab 36. One then moves the vial downward and outward over stop element 56 and along lift slope 58 causing the sealing cap lift tab to be caught on blade tip 24 and separated from sealing cap ring member 37 along ring member release scores 38 of sealing cap ring member 37. Once sealing cap 34 has been separated from the vial, portions of it may fall into an optional waste container which may be placed below the device.

The device of this invention can be affixed to a wall or other upright member in a convenient location by screws extending through holes made in the base of the device, attached by double-sided tape, or affixed by equivalent means. This device can be constructed of metal, plastic or any equivalent material although a metal blade member has been found to work most satisfactorily. In construction, the device can be molded in one piece with a blade member inserted during the molding process, or can be constructed of a lower base element and upper element forming the channels and blade retention means when affixed together, or constructed of any equivalent method of construction.

Although the present invention has been described with reference to particular embodiments, it will be apparent to those skilled in the art that variations and modifications can be substituted therefor without departing from the principles and spirit of the invention.

We claim:

1. A device for assisting in opening a vial having a vial sealing cap that incorporates a lift tab, comprising:

a body member having a channel defined therein, said channel having a back wall, a top, an open front, a bottom, and sides which are spaced apart a distance at least slightly greater than the maximum width of the lift tab;

a blade bridging a portion of the front of the channel and mounted on the body member so as to be approximately parallel to the back wall and spaced forward from it so that when the vial is held perpendicular to the blade adjacent to the back wall and moved so as to bring the vial cap into proximity with the blade, further motion of the vial causes the blade to enter into the space inside the vial cap immediately beneath a portion of the lift tab whereby the lift tab can be more readily separated from the surface of the vial cap; and means affixed to the body member for assisting in deforming the vial cap in such a way that a portion of the lift tab is caused to be partially bent away from and out of the outside surface of the vial cap, whereby the balance of the lift tab can thereafter be more readily removed through proper manipulation of the vial cap in relation to the blade.

2. A device as recited in claim 1 further comprising means incorporated into said body member for assisting in removing from the vial the ring member portion of the vial cap remaining after the lift tab has been substantially removed.

3. A device as recited in claim 1 wherein the blade is disposed near the bottom of the channel, and wherein the channel is sufficiently long that the vial cap can enter the channel from a position above the blade, such device further comprising:

a stop element, affixed to the body member, located in front of the blade, and having a contact edge located below the blade, so that the stop element's contact edge first comes in contact with the vial and prevents further direct downward movement of the vial cap, after the blade has entered the space beneath the previously bent away portion of the vial cap; and a lift slope affixed to the stop element, and mounted on the body member immediately below the contact edge of the stop element to assist in guiding the vial cap in a direction forward from the blade as the vial cap is simultaneously moved in a generally downward direction after it has contacted the stop element, thereby further assisting in removing the lift tab.

4. A device as recited in claim 3 further including means for mounting the device on a surface so as to facilitate manipulation of the vial and vial cap with respect to the device.

5. The device of claim 3 wherein the recited means for assisting in deforming the vial cap comprises a short projection from the body member and has an area that is relatively small in relation to the vial cap.

6. The device of claim 2 wherein the recited means for assisting in removing the remaining ring member portion of the vial cap comprises a portion of the body member having an aperture defined therein of size sufficient to receive an edge of the vial sealing cap with at least one edge of such aperture adapted to catch against the ring member fragment remaining after substantial removal of the lift tab.

7. The device of claim 6 wherein the mounting means comprises an adhesive surface affixed to a portion of the body member.

* * * * *